US007984811B2

(12) United States Patent
Gonzalez

(10) Patent No.: US 7,984,811 B2
(45) Date of Patent: Jul. 26, 2011

(54) PIVOTING SWIMMING POOL TOOL DEVICE

(76) Inventor: Salomon Gonzalez, Elk Grove, CA (US)

( * ) Notice: Subject to any disclaimer, the term of this patent is extended or adjusted under 35 U.S.C. 154(b) by 0 days.

(21) Appl. No.: 12/062,723

(22) Filed: Apr. 4, 2008

(65) Prior Publication Data

US 2009/0250387 A1 Oct. 8, 2009

(51) Int. Cl.
*E04H 4/16* (2006.01)

(52) U.S. Cl. ..... 210/470; 4/490

(58) Field of Classification Search ..... 210/470; 4/490; 15/1.7

See application file for complete search history.

(56) References Cited

U.S. PATENT DOCUMENTS

| | | | | |
|---|---|---|---|---|
| 4,106,157 | A | 8/1978 | Baker | |
| 4,176,419 | A | 12/1979 | MacDonald | |
| 4,822,487 | A | 4/1989 | Soich | |
| 4,846,972 | A | 7/1989 | Anderson | |
| 5,536,107 | A | 7/1996 | Baker | |
| D381,781 | S | 7/1997 | Clay | |
| D437,465 | S | 2/2001 | Radsky | |
| 6,383,374 | B1 | 5/2002 | Splendorio | |
| 2004/0108259 | A1 | 6/2004 | Giannantonio | |
| 2006/0016047 | A1 * | 1/2006 | Blackman et al. | 16/231 |

* cited by examiner

*Primary Examiner* — Fred Prince

(57) ABSTRACT

The present invention is directed to a pivoting swimming pool tool device including a pivot mechanism, a frame member, and a net to allow a person to remove large quantities of surface debris from a swimming pool.

2 Claims, 5 Drawing Sheets

PIVOTING SWIMMING POOL TOOL DEVICE

FIELD OF THE INVENTION

The present invention is directed to a pivoting swimming pool tool device including a pivot mechanism, a frame member, and a net to allow a person to remove large quantities of surface debris from a swimming pool.

BACKGROUND OF THE INVENTION

An object of this invention is to provide a pivoting swimming pool tool device that allows a person to remove large quantities of surface debris from a swimming pool.

DESCRIPTION OF PREFERRED EMBODIMENTS

Figure 1:
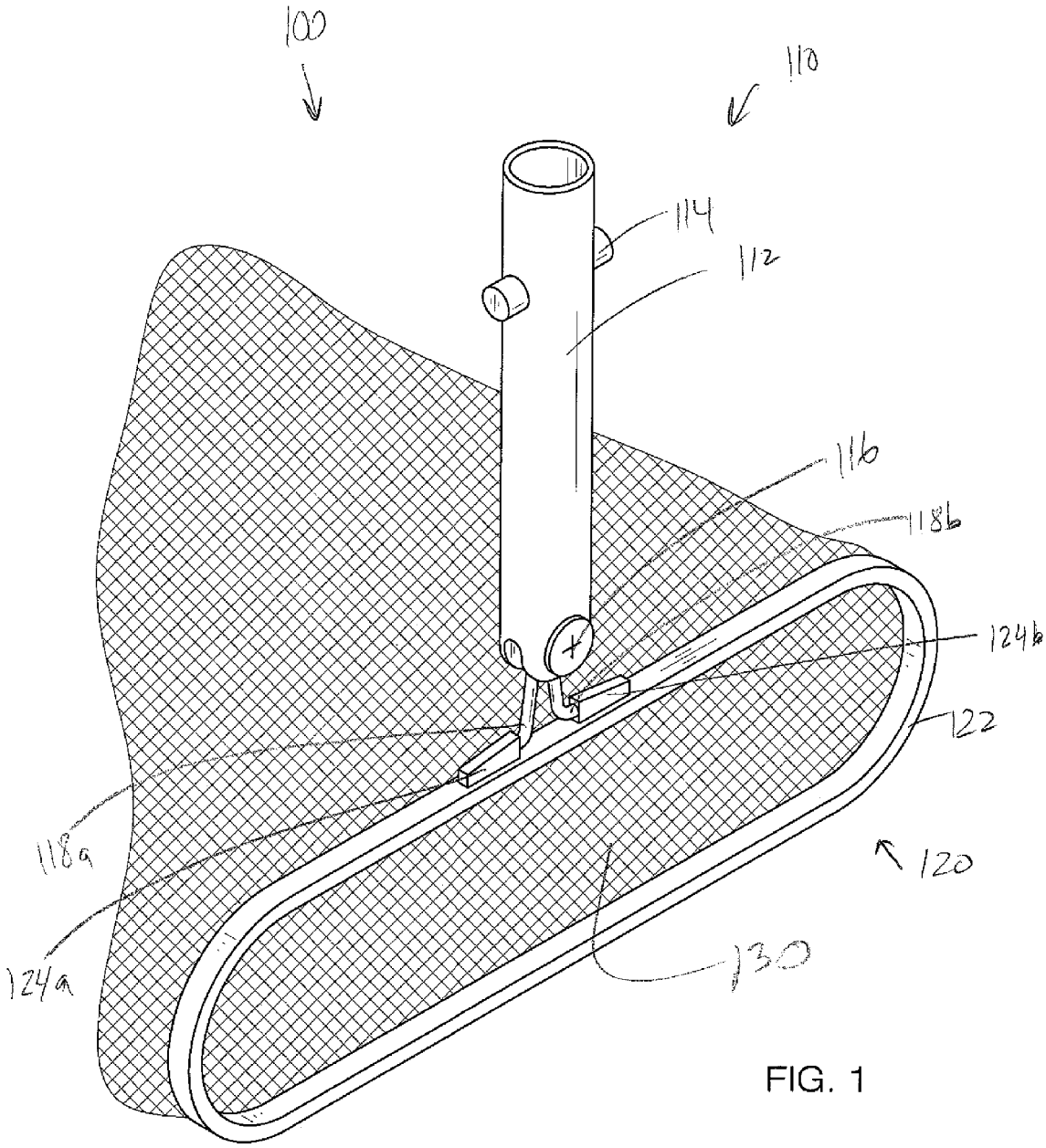
FIG. 1 is an illustration of a pivoting swimming pool tool device according to the invention including a pivot mechanism, a frame member, and a net.

Referring now to FIG. 1, pivoting swimming pool tool device 100 is shown comprising pivot mechanism 110 frame member 120, and net 130. In the illustrated embodiment of FIG. 1, pivot mechanism 110 comprises shaft 112, attachment device 114, pivot member 116, first hinge member 118*a*, and second hinge member 118*b*. In the illustrated embodiment of FIG. 1, frame member 120 comprises main frame member 122, first hinge attachment member 124*a*, and second hinge attachment member 124*b*. In the illustrated embodiment of FIG. 1, shaft 112 can pivot in a left direction and in a right direction by way of pivot member 116 (see FIG. 3). In the illustrated embodiment of FIG. 1, shaft 112 can move in a forward direction and in a backward direction by way of first hinge member 118*a* and second hinge member 118*b* (see FIG. 2). In the illustrated embodiment of FIG. 1, shaft 112 can be attached to a longer pole using attachment device 114. In the illustrated embodiment of FIG. 1, net 130 is attached to main frame member 122.

In certain embodiments, shaft 112 comprises a rigid material selected from the group consisting of metal, plastic, and combinations thereof. In certain embodiments, shaft 112 comprises a hollow tubular member having an outside diameter between about 1 inch and about 1 1/16 inches. In certain embodiments, shaft 112 comprises length between about 3.5 inches and about 4.5 inches. In certain embodiments, main frame member 122 comprises a rigid material selected from the group consisting of metal, plastic, and combinations thereof. In certain embodiments, main frame member 122 comprises an oval shaped member. In certain embodiments, pivot member 116 comprises a standard bolt pivot member known to one skilled in the art. In certain embodiments, net 130 comprises an ultra-fine netting material to ensure collection of all sizes of debris.

Figure 2:
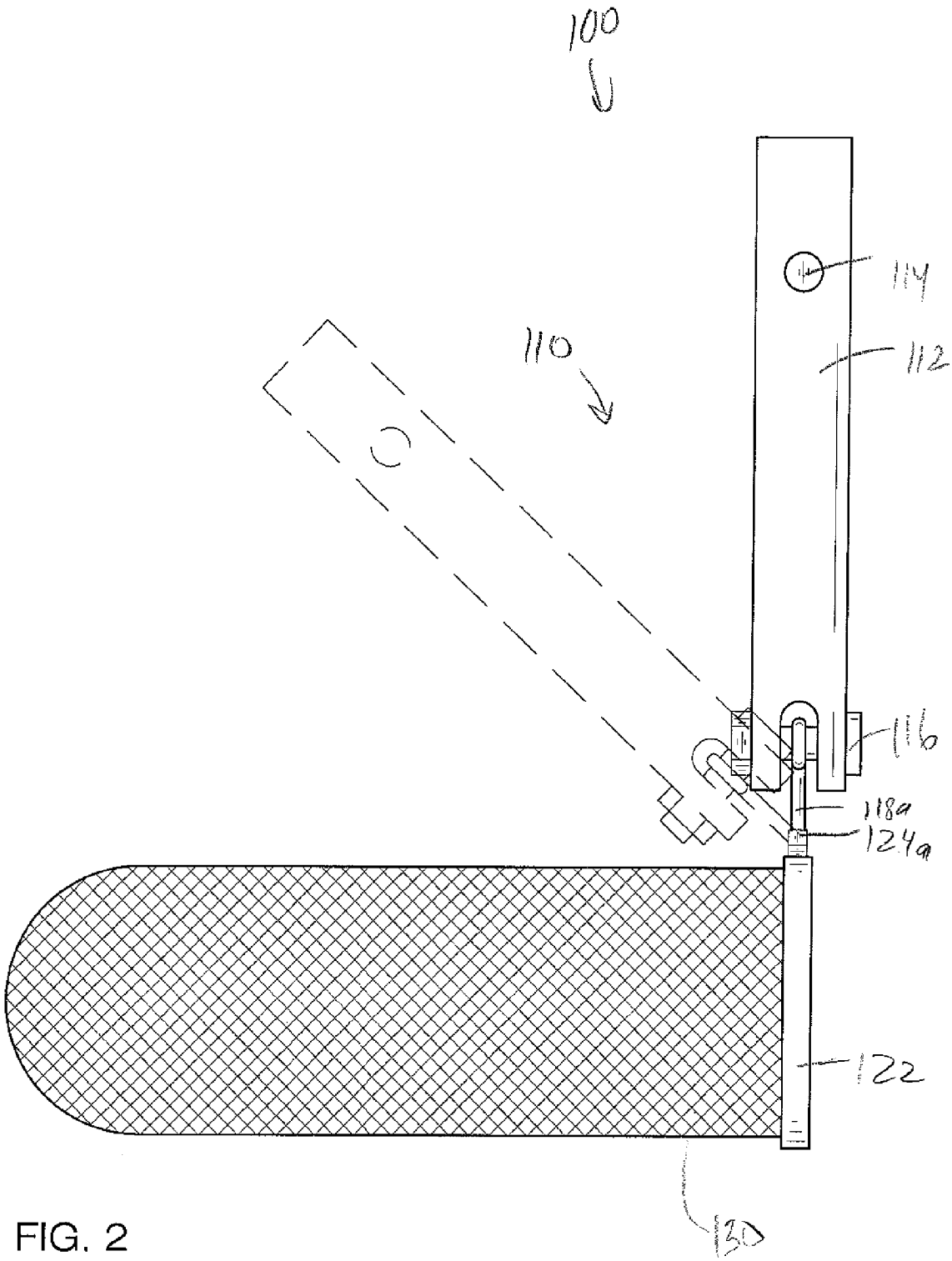
FIG. 2 is a side view of the pivoting swimming pool tool device of FIG. 1.

Referring now to FIG. 2, pivoting swimming pool tool device 100 is shown comprising pivot mechanism 110, frame member 120, and net 130. In the illustrated embodiment of FIG. 2, pivot mechanism 110 comprises shaft 112, attachment device 114, pivot member 116, first hinge member 118*a*, and second hinge member 118*b*. In the illustrated embodiment of FIG. 2, frame member 120 comprises main frame member 122, first hinge attachment member 124*a*, and second hinge attachment member 124*b*. In the illustrated embodiment of FIG. 2, shaft 112 can move in a forward direction and in a backward direction by way of first hinge member 118*a* and second hinge member 118*b*. The movement of shaft 112 allows a variety of angles when a person is cleaning out debris from a pool.

Figure 3:
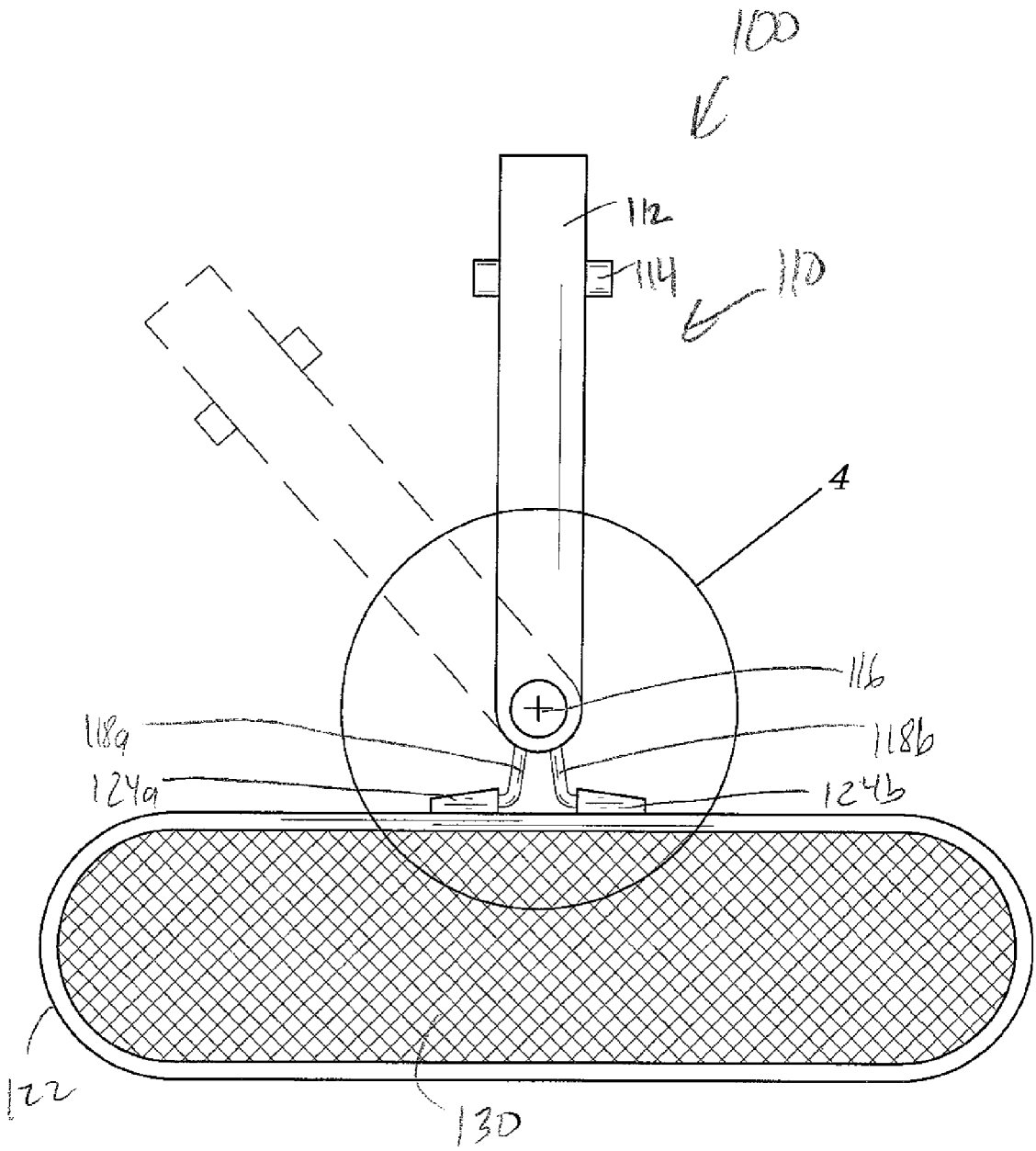
FIG. 3 is a front view of the pivoting swimming pool tool device of FIG. 1.

Referring now to FIG. 3, pivoting swimming pool tool device 100 is shown comprising pivot mechanism 110, frame member 120, and net 130. In the illustrated embodiment of FIG. 3, pivot mechanism 110 comprises shaft 112, attachment device 114, pivot member 116, first hinge member 118*a*, and second hinge member 118*b*. In the illustrated embodiment of FIG. 3, frame member 120 comprises main frame member 122, first hinge attachment member 124*a*, and second hinge attachment member 124*b*. In the illustrated embodiment of FIG. 3, shaft 112 can pivot in a left direction and in a right direction by way of pivot member 116. The movement of shaft 112 allows a variety of angles when a person is cleaning out debris from a pool.

Figure 4:
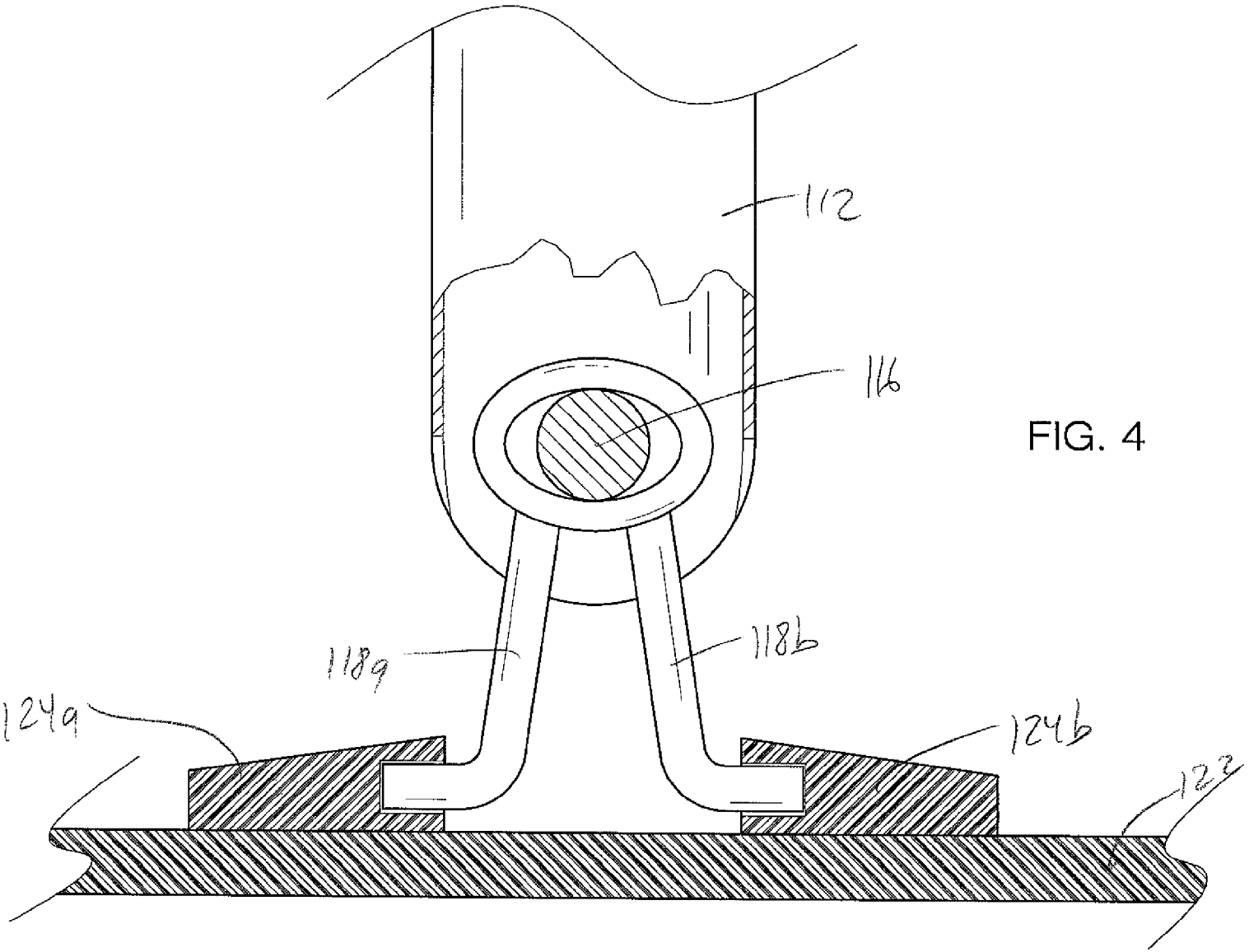
FIG. 4 is a front cross section view of the pivoting swimming pool tool device of FIG. 1.

Referring now to FIG. 4, a front cross section view of pivoting swimming pool tool device 100 is shown comprising pivot mechanism 110, frame member 120, and net 130. In the illustrated embodiment of FIG. 4, pivot mechanism 110 comprises shaft 112, attachment device 114, pivot member 116, first hinge member 118*a*, and second hinge member 118*b*. In the illustrated embodiment of FIG. 4, frame member 120 comprises main frame member 122, first hinge attachment member 124*a*, and second hinge attachment member 124*b*. In the illustrated embodiment of FIG. 4, first hinge member 118*a* fits within first hinge attachment member 124*a*. In the illustrated embodiment of FIG. 4, second hinge member 118*b* fits within second hinge attachment member 124*b*. In the illustrated embodiment of FIG. 4, first hinge member 118*a* moves within first hinge attachment member 124*a* and allows shaft 112 to move in a forward direction and in a backward direction (see FIG. 2). In the illustrated embodiment of FIG. 4, second hinge member 118*b* moves within second hinge attachment member 124*b* and allows shaft 112 to move in a forward direction and in a backward direction (see FIG. 2).

Figure 5:
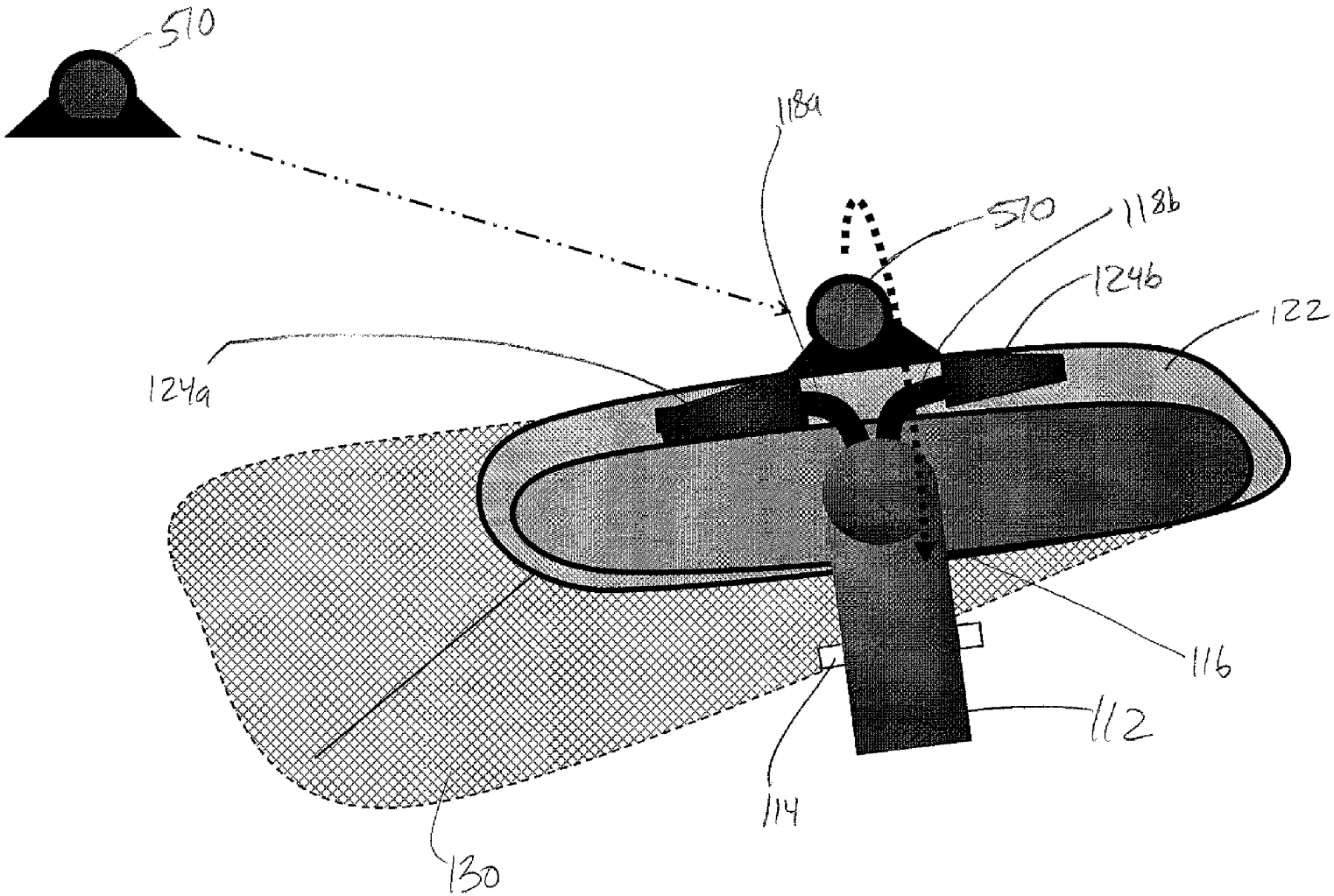
FIG. 5 shows a stopper member attached to the frame member.

Referring now to FIG. 5, pivoting swimming pool tool device 100 is shown comprising pivot mechanism 110, frame member 120, and net 130. In the illustrated embodiment of FIG. 5, pivot mechanism 110 comprises shaft 112, attachment device 114, pivot member 116, first hinge member 118*a*, and second hinge member 118*b*. In the illustrated embodiment of FIG. 5, frame member 120 comprises main frame member 122, first hinge attachment member 124*a*, and second hinge attachment member 124*b*. In the illustrated embodiment of FIG. 5, stopper member 510 is attached to frame member 120. Stopper member 510 keeps shaft 112 from bending beyond stopper member 510 when a person is using pivoting swimming pool tool device 100. A person can remove stopper member 510 if he/she desires to have shaft 112 move without any member stopping the movement.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pivoting swimming pool tool device, comprising:

a pivot mechanism comprising a shaft, an attachment device, a pivot member a thin tubular hinge, said attachment device mounted on an outer surface of said shaft to allow a handle to be releasably attached to said shaft for leverage, said pivot member attached to a bottom end of said shaft and allows said shaft to rotate in a first left direction and in a second right direction, a top end of said thin tubular hinge mounted to said pivot member, a bottom curved portion of said thin tubular hinge pivotally housed within a first hinge attachment member, a bottom curved portion of said thin tubular hinge pivotally housed within a second hinge attachment member, said thin tubular hinge allows said shaft to rotate in a first forward direction and in a second backward direction; and an oval-shaped frame member, said first hinge attachment member and said second hinge attachment member fixedly attached to a top surface of said oval-shaped frame member, said oval-shaped frame member fixedly attached to a net, said net attached to an outer surface of said oval-shaped frame member to trap debris swept into said net.

2. The pivoting swimming pool tool device of claim 1, further comprising a stopper member, said stopper member releasably attached to a backside of said shaft to allow said shaft to bend to a certain angle.

* * * * *